United States Patent [19]

Heyl

[11] Patent Number: 4,827,833

[45] Date of Patent: May 9, 1989

[54] ADJUSTABLE AXIAL PISTON PUMP HAVING A BEARING PRESSURE POCKET LOCATED ON ONE SIDE OF A ROCKER BODY

[75] Inventor: Walter Heyl, Johannesberg, Fed. Rep. of Germany

[73] Assignee: Linde Aktiengesellschaft, Wiesbaden, Fed. Rep. of Germany

[21] Appl. No.: 680,884

[22] Filed: Dec. 12, 1984

Related U.S. Application Data

[63] Continuation of Ser. No. 414,669, Sep. 3, 1982.

[51] Int. Cl.[4] ..... L01B 13/04

[52] U.S. Cl. ..... 92/12.2; 91/306

[58] Field of Search ..... 91/486–488, 91/499, 504–506; 417/218, 222; 92/12.2

[56] References Cited

U.S. PATENT DOCUMENTS

| | | | |
|---|---|---|---|
| 3,009,422 | 11/1961 | Davis, Jr. et al. | 417/222 |
| 3,124,008 | 3/1964 | Firth et al. | 91/506 X |
| 3,631,764 | 1/1972 | Lucien | 417/222 X |
| 3,682,044 | 8/1972 | Ankeny et al. | 91/506 X |
| 3,779,137 | 12/1973 | Koivunen | 91/489 |
| 3,868,889 | 3/1975 | Bobier | 91/506 |
| 4,142,452 | 3/1979 | Forster et al. | 91/506 |

FOREIGN PATENT DOCUMENTS

| | | | |
|---|---|---|---|
| 2101078 | 8/1972 | Fed. Rep. of Germany | 91/488 |
| 2254809 | 6/1973 | Fed. Rep. of Germany | 91/488 |
| 134795 | 3/1979 | German Democratic Rep. | 91/488 |
| 1508265 | 4/1978 | United Kingdom | 91/499 |

*Primary Examiner*—William L. Freeh

*Attorney, Agent, or Firm*—Thomas R. Shaffer

[57] ABSTRACT

An adjustable axial piston pump in swash plate design is provided in which the piston support surface (swash plate) is formed in a semi-cylindrical rocker body, whose cylindrical surface is supported in a sliding manner in a hollow-cylindrical bearing box, in which case a pressure pocket recess is provided for hydrostatic relief of the bearing surface and it is connected with a pressure medium source, whereby this axial piston pump has one connection that is always a feed line connection and a second connection that is always a suction line connection and whereby the pressure pocket recess is located only the side of rocker body relative to the axis of rotation of the cylindrical drum on which the working pistons acted upon by feed pressure are supported.

11 Claims, 1 Drawing Sheet

ADJUSTABLE AXIAL PISTON PUMP HAVING A BEARING PRESSURE POCKET LOCATED ON ONE SIDE OF A ROCKER BODY

This application is a continuation of application Ser. No. 414,669 filed Sept. 3, 1982 and reference is made therein to copending application Ser. No. 414,668 now abandoned, filed concurrently therewith and related thereto.

This invention relates to axial piston pumps and particularly to adjustable swash plate axial piston pumps in which the piston support surface is formed in a semi-cylindrical rocker body.

The invention concerns, more particularly, an adjustable axial piston pump in swash plate design, in which the piston support surface (swash plate) is formed in a semi-cylindrical rocker body whose cylindrical surface is supported in a hollow-cylindrical bearing box in a sliding manner, in which case a pressure pocket recess is effected in the cylindrical surface of the rocker body or in the bearing box and it is connected with a pressure medium source, whereby the axial piston pump always feeds in one direction and thus has a connection that is always a feed line connection and it has a second connection that is always a suction line connection, in which case the pump is provided for a drive direction of rotation. A pressure cushion is formed in the pressure pocket recess when the latter is acted upon by pressure medium; this pressure cushion counteracts the support forces acting on the rocker body and thus reduces the bearing load of the cylindrical surface in the bearing box.

The invention proposes to render the support ratios as favorable as possible at the minimum possible production cost.

For solving this problem, it is provided according to the invention that the pressure pocket recess is located only on the side of the rocker body on which the pistons acted upon by feed pressure are supported and on which great forces thus act on the rocker body. The costs for the production of the pressure pocket recess and the channels through which the pressure medium is fed to it are thus saved on the side of the rocker body where the bearing loads are so small that a satisfactory operation is assured even without such a pressure cushion.

It is provided in an expedient embodiment of the invention that the bearing box is divided into two transverse or preferably longitudinal sectional strips. It can be advantageous here to make the sectional bearing box strips wider on the side of the rocker body on which the pistons acted upon by high pressure are supported than on the other side on which lesser forces act. In this case the pressure cushion is formed between the wider sectional strip of the bearing box and the rocker body. In order to be able to delimit specifically the surface on which the pressure cushion coming from the pressure pocket recess propagates in the bearing gap, it can also be provided that a traversing groove connected with the interior of the housing is formed in the cylindrical surface of the rocker body or in the bearing box or one each side of the pressure pocket recess, along which a section of the bearing box remains, in front of which no pressure cushion develops, but only the normal film of lubrication.

In an axial piston machine in which the controlling forces act on the rocker body at least approximately parallel to the axis of rotation of the cylindrical drum it can be provided that the elements generating the controlling forces, in particular, operating cylinders and servo pistons, and possibly springs, are supported on the side of the rocker bosy on which the working pistons acted upon by high pressure are supported. In an axial piston machine in which the pressure pocket recess is connected with the high pressure line and the adjusting mechanism is also acted upon by high pressure, it is advantageously provided that the connection between the high pressure line and the pressure pocket recess is produced by boreholes in the servo piston and channels in the rocker body.

In the foregoing general description of this invention certain objects, purposes and advantages of the invention have been set out. Other objects, purposes and advantages of this invention will be apparent from a consideration of the following description and from the accompanying drawing in which:

The drawing illustrates in elevation the rocker body in the direction of the axis of rotation of the cylindrical drum from the cylindrical drum side of a pump according to this invention.

Figure 1:
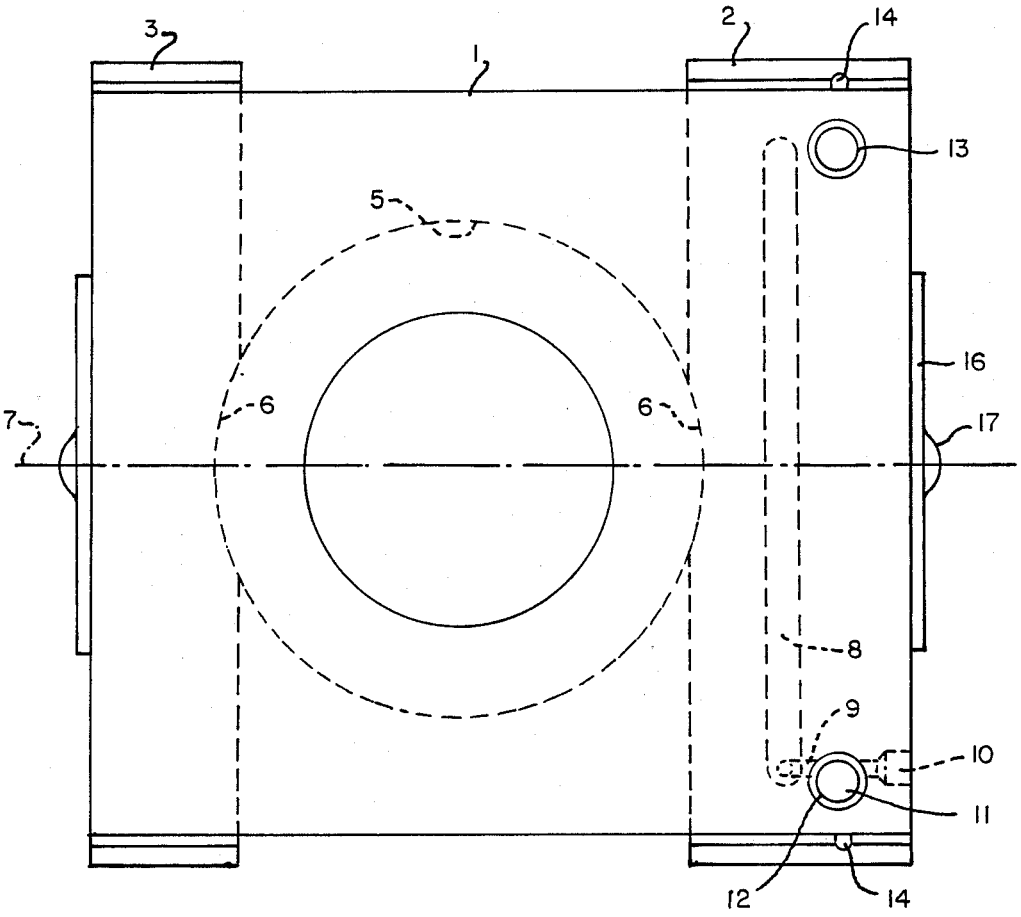
FIG. 1 is a top plan view of a rocker body.

Referring to the drawing, there is illustrated a rocker body 1 provided, on the side facing the viewer, with a flat piston slide surface and on the side facing away from the viewer with a semi-cylindrical surface that is supported in two sectional bearing box strips 2 and 3, where each sectional bearing box strip 2 and 3 is hollow-cylindrical on the inside. The rocker body 1 has a central recess 4 through which the shaft (not shown in the drawing) of the axial piston machine is passed and is supported in a roller bearing (not shown in the drawing either), whose outer contour is represented by the dashed line 5. Each of the bearing section strips 2 and 3 has a recess 6 that lies on the outer contour of the roller bearing and thus prevents a swivelling of the bearing section strip in the direction of sliding.

The axial piston pump is designed so that the working pistons acted upon by high pressure are supported on the side of the axis of rotation to the right in the drawing. The swivel axis of the rocker body is designated by 7. The rocker body 1 extends from the axis of rotation of the cylindrical drum (coaxial to the recess 4) considerably further to the right in the drawing than to the left in the drawing.

On the right-hand side of the rocker body 1 in the drawing a pressure pocket recess 8 is formed in its cylindrical surface. This recess is supplied with pressure medium through a transverse borehole 9, in which case the latter, which is closed by a stopper 10, empties into a borehole 11 that runs normal to the plane of the drawing and is connected in a manner not shown in the drawing with a longitudinal borehole in the servo piston, which is supported with a calotte in the ball socket 12. The second servo piston is supported in the ball socket 13.

A groove 14 is provided in the sectional bearing box strip 2.

When the pressure pocket recess 8 is loaded with pressure medium through channels 9 and 11, a pressure cushion coming from the pressure pocket recess 8 forms in the bearing gap between the rocker body 1 and the bearing section strip 2, to the left in the drawing up to the outer contour of the sectional bearing box strip 2 and to the right in the drawing up to the groove 14, which is connected with the inside of the housing at both ends of the sectional bearing box strip 2 and is thus relieved of pressure.

The section of the bearing box strip 2 lying to the right of the groove 14 in the drawing, just as the sectional bearing box strip 3, transfers only a lubrication film that forms in the normal manner. By selecting the distance of the groove 14 from the edge of the sectional bearing box strip 2, the size of the pressure cushion can be optimally determined.

The guiding plates 16 guide the rocker body 1 in the lateral direction. In order to prevent them from swivelling together with the rocker body 1, a protrusion 17 is provided at each guiding plate 16, which snaps into a recess in the housing (not shown in the drawing).

Reference is made to my copending application, Ser. No. 414,668, filed herewith for a full and complete disclosure of the entire axial piston pump structure of an axial piston pump of the form in which this invention is incorporated.

Figure 2:
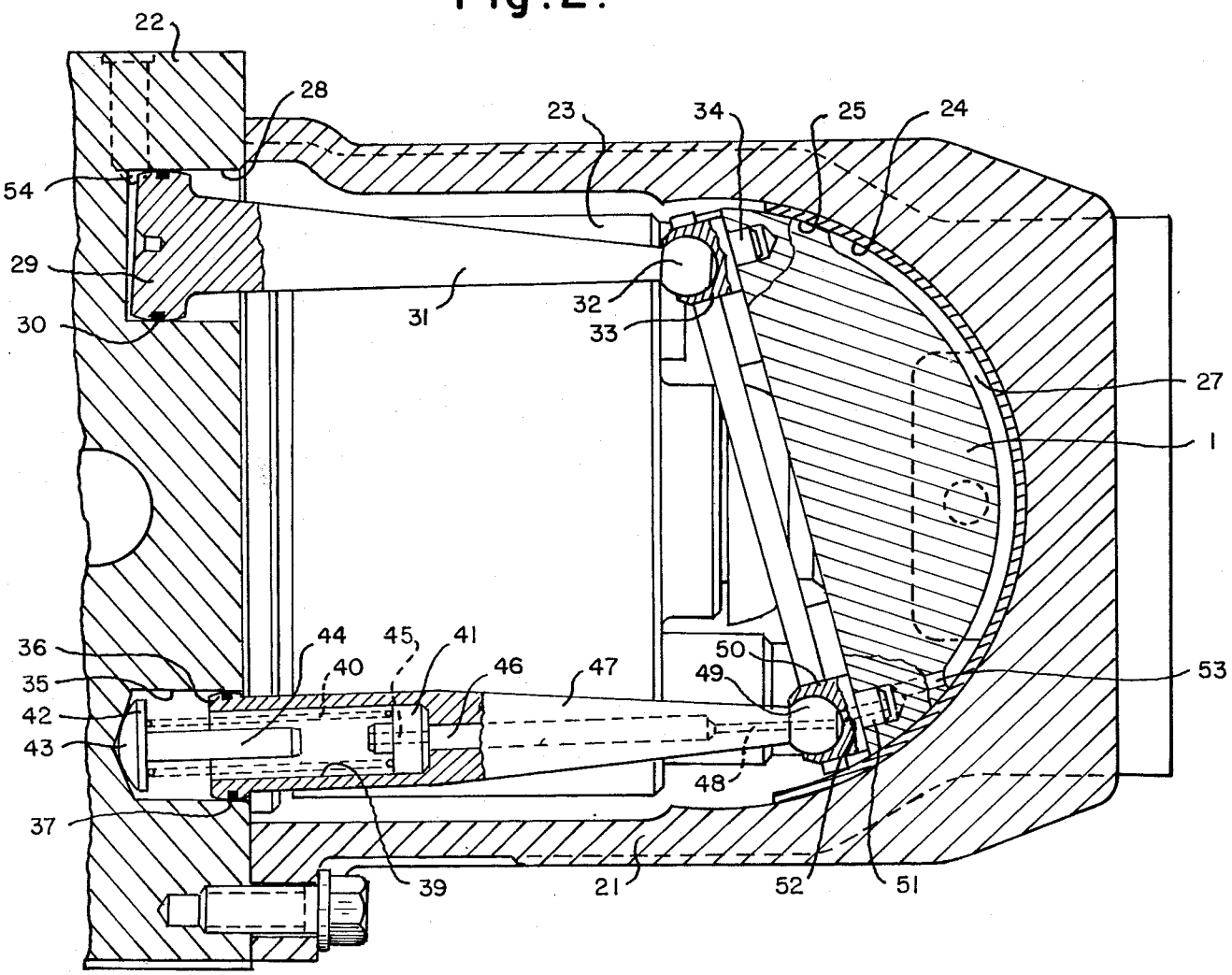
FIG. 2 is a section through a pump according to the invention.

In FIG. 2, I illustrate the pump structure as illustrated and described in said application Ser. No. 414,668, which is the basic structure which the present invention modifies. Referring to FIG. 2, I provide a housing 21 closed off by the housing bottom 22, in which the channels for delivering to and draining the fluid from the cylindrical drum 23 are simultaneously located. A hollow-cylindrical bearing surface 24 is formed in the housing 21 and the rocker body 1 is supported in it with a cylindrical surface 25, in which case a pressure pocket recess 27 is formed in the rocker body 1 in the cylindrical surface 25. On the upper side of the housing bottom 22, in the drawing, an operating cylinder 28 is provided in it, and a spherical servo piston 29 that is provided with a piston ring 30 for sealing is capable of sliding in it. The servo piston 29 is in one piece with the piston rod 31, on which a ball head 32 is formed and supported in a ball socket 33, which is inserted with a pin 34 into a corresponding borehole of the rocker body 1.

Analogously, an operating cylinder 36 is formed in the lower portion of the housing bottom 22. A servo piston 36 is capable of sliding in it. The servo piston 36 is also spherical just as the servo piston 29 and is provided with a sealing ring 37. However, operating cylinder 35 has a smaller diameter than operating cylinder 28. The two operating cylinders 28 and 35 are connected with the high pressure feed channel 38 through boreholes (not shown in the drawing) and a control mechanism.

A borehole 39 is effected in servo piston 36 and it contains a helper spring 40 that is supported against a spring plate 41 and also against a spring plate 42, which is supported with a ball cap 43 at the bottom of the operating cylinder 35 and has a prolongation 44 for the purpose of guiding the spring 40.

A borehole 45 is provided in the spring plate 41 and it is connected with a borehole 46 in the piston rod section 47, in which case the latter is also in one piece with the servo piston 36, just as the piston rod 31 with the servo piston 29. In the more slender portion of the piston rod section 47 the borehole 46 extends into a borehole 48, which empties in the surface of the ball head 49 that is supported in a ball socket 50, which has an extension 51 that is supported in a correspondig borehole in the rocker body 1. A borehole 52 is also formed in the ball socket 50 and the pin 51 and it is connected in any position of the piston rod section 47 with the borehole 48 and is also connected with a borehole 53 in the rocker body 1, which empties in the pressure pocket recess 27.

In the foregoing specification, I have illustrated and described certain preferred practices and embodiments of this invention, however, it will be understood that this invention may be otherwise embodied within the scope of the following claims.

I claim:

1. In an adjustable axial piston pump of swash plate design having a housing, in which the support surface of the piston is formed in a semi-cylindrical rocker body whose cylindrical surface is supported in a sliding manner in a hollow-cylindrical bearing box in said housing, adjusting means in the housing acting on said rocker body to move the same in the bearing box, and in which the axial piston pump has a first connection that is always a feed line connection delivering pressure fluid to selected working pistons, and a second connection that is always a suction line connection receiving fluid from the remaining pistons, the improvement comprising a single pressure pocket recess located only on the side of the rocker body on which the working pistons acted upon by the feed pressure from the first connection are supported whereby the pressure on the rocker body from said working pistons is counterbalanced by pressure in said pressure pocket recess, said bearing box consisting of two sectional bearing box strips, one of said two sectional bearing box strips located on the side of the rocker body on which the working pistons acted upon by high pressure are supported being wider than the other sectional bearing box strip on the side of the rocker body on which the working pistons producing the suction effect are supported.

2. Axial piston pump according to claim 1 characterized in that the rocker body extends farther from the axis of rotation of the cylindrical drum and the shaft on the side on which the working pistons acted upon by high pressure are supported than on the side on which the pistons effecting the suction function and/or acted upon by a low pressure are supported.

3. Axial piston pump according to one of claim 1 in which the adjusting means includes servo pistons supported against the rocker body, characterized in that the servo pistons are supported on the side of the rocker body on which the working pistons acted upon by high pressure are supported.

4. Axial piston pump according to claim 3 in which the pressure pocket recess is connected with the high pressure line and the adjusting means is acted upon by high pressure, characterized in that the connection between the high pressure line and the pressure pocket recess is produced by boreholes in the servo piston.

5. Axial piston pump according to claim 3 in that the rocker body extends farther from the axis of rotation of the cylindrical drum and the shaft on the side on which the working pistons acted upon by high pressure are supported than on the side on which the pistons effecting the suction function and/or are actedupon by a low pressure are supported.

6. Axial piston pump according to claim 1 in which the pressure pocket recess is connected with the high pressure line and the adjusting means is acted upon by high pressure, characterized in that the connection between the high pressure line and the pressure pocket recess is produced by boreholes in a servo piston included in said adjusting means.

7. Axial piston pump according to claim 6 in that the rocker body extends farther from the axis of rotation of the cylindrical drum and the shaft on the side on which the working pistons acted upon by high pressure are supported than on the side on which the pistons effecting the suction function and/or are acted upon by a low pressure are supported.

8. In an adjustable axial piston pump of swash plate design having a housing, in which the support surface of the piston is formed in a semi-cylindrical rocker body whose cylindrical surface is supported in a sliding manner in a hollow-cylindrical bearing box in said housing, adjusting means in the housing acting on said rocker body to move the same in the bearing box, and in which the axial piston pump has a first connection that is always a feed line connection delivering pressure fluid to selected working pistons, and a second connection that is always a suction line connection receiving fluid from the remaining pistons, the improvement comprising a single pressure pocket recess located only on the side of the rocker body on which the working pistons acted upon by the feed pressure from the first connection are supported whereby the pressure on the rocker body from said working pistons is counterbalanced by pressure in said pressure pocket recess, said bearing box consisting of two sectional bearing box strips, and characterized in that a groove extending in the direction of sliding is located at a distance alongside the pressure pocket recess in the sectional bearing box strip which is located on the side of the rocker body on which the working pistons acted upon by high pressure are supported.

9. Axial piston pump according to claim 8, characterized in that the sectional bearing box strip located on the side of the rocker body on which the working pistons acted upon by high pressure are supported is wider than the sectional bearing box strip on the side of the rocker body on which the working pistons producing the suction effect are supported.

10. Axial piston pump according to claim 8 or 9 in which the adjusting means includes servo pistons supported against the rocker body, characterized in that the servo pistons are supported on the side of the rocker body on which the working pistons acted upon by high pressure are supported.

11. Axial piston pump according to claim 8 or 9 in which the adjusting means includes a servo piston supported against the rocker body and the pressure pocket recess is connected with the high pressure line and the adjusting means is acted upon by high pressure, characterized in that the connection between the high pressure line and the pressure pocket recess is produced by boreholes in the servo piston.

* * * * *